US005381777A

United States Patent [19]

Mitchell et al.

[11] Patent Number: 5,381,777

[45] Date of Patent: Jan. 17, 1995

[54] COMPOUND BOW AND YOKE ADJUSTER

[75] Inventors: J. Patrick Mitchell; Terry Ploot, both of Hastings, Mich.

[73] Assignee: Pro Line Company, Hastings, Mich.

[21] Appl. No.: 129,670

[22] Filed: Sep. 30, 1993

Related U.S. Application Data

[63] Continuation-in-part of Ser. No. 106,031, Aug. 12, 1993.

[51] Int. Cl.[6] ..... F41B 5/00

[52] U.S. Cl. ..... 124/25.6; 124/23.1; 124/90

[58] Field of Search ..... 124/25.6, 23.1, 90, 124/900

[56] References Cited

U.S. PATENT DOCUMENTS

| | | | |
|---|---|---|---|
| 4,079,723 | 3/1978 | Darlington . | |
| 4,202,316 | 5/1980 | Barna . | |
| 4,300,521 | 11/1981 | Schmitt . | |
| 4,338,910 | 7/1982 | Darlington . | |
| 4,440,142 | 4/1984 | Simonds | 124/25.6 |
| 4,448,183 | 5/1984 | Quartino et al. . | |
| 4,478,203 | 10/1984 | Hayes . | |
| 4,781,167 | 11/1988 | Martin . | |
| 4,886,039 | 12/1989 | Wagner | 124/25.6 |
| 4,909,231 | 3/1990 | Larson . | |
| 4,957,094 | 9/1990 | Pickering et al. . | |
| 5,031,599 | 7/1991 | Cruise . | |
| 5,174,268 | 12/1992 | Martin et al. . | |

OTHER PUBLICATIONS

Cover Page of XI Archery Dealer Price List for Compound Bows and Accessories (Price Effective Dec. 1, 1991), publication date unknown.

Western Bowhunter Journal, May 1993, p. 66.

"1993 Browning Archery Products", Browning Catalogue, pp. 3–4.

Jennings 1993 Catalogue, pp. 4–5, publication date unknown.

*Primary Examiner*—Randolph A. Reese

*Assistant Examiner*—Anthony Knight

*Attorney, Agent, or Firm*—Varnum, Riddering, Schmidt & Howlett

[57] ABSTRACT

An improvement is provided for a compound bow having upper and lower limbs, upper and lower draw pulleys mounted respectively on free outer ends of the upper and lower limbs, a cable system reeved about the pulleys, and a yoke assembly for mounting an end of the cable to the free outer end. The improvement comprises the yoke assembly having a body with two outer mounting fixtures and the cable mounted to the body. Two cable segments affix the limb free outer end on opposite sides of the pulley and to the mounting fixtures. An adjusting mechanism associated with each mounting fixture allows the tension in each cable segment to be separately adjusted.

15 Claims, 10 Drawing Sheets

COMPOUND BOW AND YOKE ADJUSTER

This is a continuation-in-part of U.S. application Ser. No. 08/106,031 filed Aug. 12, 1993, now pending.

BACKGROUND OF THE INVENTION

1. Field of the Invention

The present invention relates to an improved compound bow.

2. State of the Prior Art

Compound bows have a number of advantages over conventional archery bows. Because of these advantages, the use of compound bows has increased and compound bows have been gaining in popularity.

In a conventional bow, the force required to draw the bow is determined by the bow's stiffness and the draw force increases in a relatively uniform manner as the bow is drawn. The fact that the force required to draw the bow increases uniformly imposes limitations on the use of the bow. By way of example, if the bow requires a draw force of 50 pounds, the archer must be able not only to draw the bow, but also to hold the bow in a steady position during sighting and discharge of an arrow. While the archer may be able to draw a relatively heavy bow, he may not be able to hold the bow in a steady position during the sighting and release of the arrow while maintaining the force on the bow necessary to keep it in its fully drawn position.

In a compound bow, the draw force does not increase in a uniform manner as the bow is drawn. Through the use of eccentrically mounted pulleys positioned at the ends of the bow limbs, the effective length of the bow limbs is increased during draw of the bow through the rotation of the eccentrically mounted pulleys. By the rotation of the eccentrically mounted pulleys, the force required to maintain the bow in a fully drawn position is decreased with the result that the force required to maintain the bow in the fully drawn position during sighting and release of the arrow is less than the maximum force required in drawing the bow. In the case of a bow having a draw weight, for example, of 50 pounds, the maximum force required in drawing the bow is 50 pounds. However, near the end of the draw, the action of the draw pulleys reduces the force required to hold the bow in the fully drawn position. This "let-off" can range up to 65% or more depending upon the size and eccentricity of the draw pulleys. As the arrow is discharged, the draw pulleys undergo rotational movement which is opposite to the rotational movement that occurs during draw. With the reverse rotational movement of the draw pulleys, the force that is applied to the arrow by the bow is increased, with the result that the bow discharges the arrow under a propulsive force that is higher than the force required to hold the bow during sighting and discharge of the arrow.

The energy which is stored in an archery bow during draw may be determined by integrating the area under the force draw curve of the bow. In the case of a standard bow, the draw force curve increases approximately linearly when the draw force is plotted vertically and the draw distance is plotted horizontally. The force increases continuously as the bow is drawn, with the draw force increasing to a maximum when the bow is fully drawn. However, in a compound bow the draw force curve does not increase linearly, but rather is a curve in which the draw force increases rapidly until a maximum is reached with the draw force then decreasing due to the let-off resulting from the rotation of the eccentrically mounted pulleys. The stored energy, which is represented by the area under the draw force curve, may be greater for a compound bow than the amount of stored energy for an equivalent standard bow having the same draw length and maximum draw force. The compound bow may, therefore, be more efficient in storing energy during the draw of the bow so that in order to store the same amount of energy with a standard bow, it would be necessary to use a bow with either a greater draw length or a greater maximum draw weight.

One problem with the general design of compound bows, which are currently in use throughout the industry, is the result of unbalanced cable loads. Those unbalanced cable loads are inherent in the basic design generally used in the industry. Specifically, the cable loads are unbalanced because the ends of the cables are not attached in a central position at the ends of the limbs, and during draw these unbalanced cable loads cause a differential bending or twisting of the bow limbs.

A typical compound archery bow comprises a handle with upper and lower limbs extending from the handle. Each limb tip carries a transverse axle upon which an eccentric pulley or cam is rotatably mounted. A bow string and cable arrangement is reeved about the pulleys. There are many different ways in which the bow string can be arranged, but a common arrangement comprises a continuous cable having one end attached to the upper pulley axle, a first cable segment extending across the bow, and wrapping about the lower pulley, a central stretch extending across the bow towards the upper pulley, and a second cable segment wrapping about the upper pulley, and extending across the bow, with the opposite bow string end attaching to the lower pulley axle.

Certain design criteria are normally required for all compound bows. For example, the bow string should be at or near the center of the limb, and if the bow string is off center it must be off center to the left for a right-handed bow. This is because a right-handed bow is generally loaded with an arrow from the left side of the bow. Another design criteria is that the load bearing cables must not interfere with the loading of the arrow and the positioning and flight of the arrow when the bow is shot. These design criteria result in a design for the compound bow where the load bearing cables are generally positioned to the right side of the bow string for a right-handed bow, and with the ends of the cables on the right side of the eccentrically mounted pulley wheel. The positioning of the load bearing cables to the right side provides for the cables to be away from the bow string.

As the bow string is drawn, this provides for variations in load in both the load bearing cables and the drawstring which apply a varying torque to the pulley axle, and these variations in load are generally the reverse of each other. This load effect produces a lateral instability in the bow limbs when the bow string is drawn. The instability is present to a greater or lesser extent and is generally dependent on the relative location of the various load bearing elements along the axles which support the eccentric wheels and the ends of the load bearing cables.

Torque is primarily applied to bow pulleys about axes in two separate planes. The first torque, rotational torque, is applied about the pulley's normal axis of rotation, its rotational mount. The second torque, limb torque, is applied about an axis in a plane normal to the rotational axis of the pulleys. Limb torque attempts to tip the pulleys sideways and is opposed by the limbs, thus developing a torsion in the limb tips.

Rotational torques are applied to the pulley by the force of the bowstring acting in the string groove of the pulley and by the force of the draw cable acting in the cable groove. The lever arm through which each of the draw cable and bow string applies its torque is the distance from the axle to the point of tangency of the cable or string section in the groove. The lever arms are sometimes discussed in terms of the effective diameter of the groove, which is twice the length of the lever arm.

When the pulley is not rotating, such as when the bow is held at full draw, the torques applied by the draw cable and the bow string are necessarily equal. Thus, the force applied by the bow string, $F_S$, multiplied by the lever arm in the string groove, $L_S$, equals the force applied by the draw cable, $F_C$, multiplied by the lever arm in the take-up groove. ($F_S \cdot L_S = F_C \cdot L_C$). The ratio of the lever arm, defined by the bow string in the string groove to the lever arm defined by the draw cable in the cable groove, determines the mechanical advantage supplied by the pulleys to the archer. The greater the mechanical advantage supplied by the pulleys, the higher the force in the draw cable at full draw. ($F_C = F_S \cdot L_S / L_C$).

Total limb torque applied to the limbs is determined by the magnitude of the force vectors applied by the string sections and their placement along the pulley axle. The axis about which limb torques are applied, the limb torsional axis, lies normal to the pulley's axis of rotation about the axle and passes somewhere through a central portion of the pulley axle. The exact location of the limb torsional axis depends upon the composition and structure of the limb. Thus, the distance along the axle from the limb torsional axis to the point where a force is applied defines the lever arm for that force, and the limb torque produced by the force equals the magnitude of the force multiplied by the lever arm for the force.

Three sections of the bowstring apply torsion producing forces to the limb tips: the bow string in the string groove, the draw cable in the cable groove, and the fixed end from the opposite pulley draw cable which is typically attached directly to the pulley axle adjacent the cable groove. Typically the bow string is located at one end of the axle, the fixed end at the opposite end of the axle, and the cable groove in between these other two string sections.

There are thus three basic methods to reduce the limb torque: reduce the length of the lever arms through which the forces act, reduce the magnitudes of the forces, or balance the resultant torques. The trend in pulley designs addresses the first method. Today's narrower pulleys and shorter pulley axles minimize the lever arms through which the forces in the cables and string are applied. Reducing the mechanical advantage supplied by the pulleys would also reduce the torque imbalance by reducing the magnitude of the force in the draw cables relative to the force in the bow string, but may have adverse effects upon other aspects of the bow's performance.

In the prior art, there have been attempts to solve this problem of lateral instability through balancing the torques applied to the pulley axle by dividing and redistributing the cable loads along the pulley axle, so as to minimize any lateral instability in the bow limbs. A separate yoke structure for each limb effectively divides each cable load and allows the distribution of that load to the axle on both sides of the pulley. Several methods for dividing the forces in the fixed ends of the cable segments are disclosed in the prior art.

For instance, U.S. Pat. No. 4,202,316 to Barna, issued May 13, 1980, discloses a compound bow having a cable system reeved about pulleys mounted at the distal ends of the bow limbs, and employing somewhat unconventional sprocketed pulleys and a beaded section of the cable engaging the pulleys. The continuous cable arrangement comprises a rigid U-shaped yoke connected to the lower limb tip from whence the cable extends across the bow, around the upper pulley, across the bow, around the lower pulley, across the bow, and terminates in a second U-shaped yoke attached to the tip of the upper limb. Each yoke includes a bifurcated portion, formed by a pair of arm members spaced apart from one another at a first end and connected to one another at a second end. Bores on the first ends of each arm member axially align and mount onto the pulley axle, with the pulley disposed between the arm members. The U-shaped yoke thus distributes the force from the cable equally on both sides of the pulley to reduce limb torque caused by forces in the cables.

U.S. Pat. No. 4,300,521 to Schmitt, issued Nov. 17, 1981, discloses a compound bow wherein the fixed ends of the draw cables are connected to the bow limb tips by pulley-type yoke structures. A cable system is received about draw pulleys located at the distal ends of the bow limbs. Each yoke structure is formed by an idler pulley and a short length of attachment cable wrapped around the idler pulley. The ends of the attachment cable couple to the draw pulley's axle shaft by means of coupling sleeves, mounted one on each side of the pulley. The end of the draw cable loops through an opening in the center of idler pulley to attach the idler pulley to the draw cable. This yoke structure also distributes forces in the draw cable more evenly along the pulley axle to reduce the torque applied to the limb tip when the bow is drawn.

U.S. Pat. No. 5,174,268 to Martin, et al, issued Dec. 29, 1992, discloses a compound archery bow wherein tension adjusting yoke structures attach the fixed ends of the draw cables to the bow limb tips. The yoke assembly appears to comprise a cable tension device having an aperture for receiving an end loop in the draw cable and a second aperture for receiving a yoked loop of attachment cable. The yoked loop of cable extends from an attachment on one portion of an axle mounting the eccentric wheel, through the aperture in the tensioning device, and back towards the axle to be mounted thereto by a second mounting device on an opposite side of the eccentric wheel from the first mounting device. The yoke structure thus distributes the force from the cable equally to reduce limb torque caused by forces in the cables.

Each of the bows disclosed in these three references employs a somewhat complicated yoke structure to distribute the forces from the cables evenly along the pulley axle.

An additional problem in archery bows lies in stringing and unstringing the bow. Particularly in a compound archery bow, when the bow is strung, the cables are under great tension. To unstring the bow, the bow is typically placed into a bow press which presses the ends of the limbs toward one another to relieve the stress on the string. With the tension relieved in the string and cables, the bow may be readily restrung. However, bow presses are typically too bulky to carry into the field, thus making field restringing extremely difficult.

SUMMARY OF THE INVENTION

The compound bow of the present invention overcomes these limitations of prior compound archery bows and provides a compound bow wherein the fixed cable ends are divided into separate end segments and the tension is separately adjustable in the end segments.

A compound bow according to the invention comprises a center handle portion, first and second limbs having inner ends connected to the center handle portion, and free outer ends. Each of the first and second limbs has a pulley mounted on its respective outer free end, and a cable, under tension, extends between the pulley on one free outer end and the other free outer end. At least one end of the cable mounts to a free outer end by a yoke assembly.

An improvement in the yoke assembly comprises a body having two outer mounting fixtures and the cable end mounted to the body. Two cable segments each have a first end and a second end. The first ends mount to the outer free end on opposite sides of the pulley, the second ends mount to the outer mounting fixtures on the body. An adjusting mechanism is associated with each outer mounting fixture wherein each cable segment will be under tension, and the adjusting mechanism enables independent adjustment of the tension in each cable segment.

The body can further comprise a central mounting fixture disposed between the outer mounting fixtures with the central mounting fixture mounting the cable end to the body. Preferably, the outer mounting fixtures and the central mounting fixture are in rank.

Each of the adjusting mechanisms can comprise a threaded opening in the body and a threaded fitting within the opening. The cable segment second end mounts to the fitting, whereby adjustment of the threaded fitting within the threaded opening adjusts the tension in the cable segment. Preferably, the cable segment aligns axially with the fitting. The threaded fitting further comprises a coaxial bore therethrough, the cable segment passes coaxially through the bore, and the cable segment second end further comprises a stop having a dimension larger than the bore wherein the stop abuts the fitting and will not pass through the bore.

Each of the cable segment first ends can be provided with a loop, whereby one of the loops receives a boss located on one side of the respective pulley, and the other loop receives a boss on the opposite side of the pulley. An axle preferably mounts at least one of the pulleys to its respective limb free outer end and also carries a pair of mounting brackets. Each mounting bracket has an elongated body with an aperture receiving the axle. One of the mounting brackets is received on the axle on one side of the pulley, and the other mounting bracket is received on the axle on the opposite side of the pulley. Each of the mounting brackets has one of the bosses mounted thereto.

BRIEF DESCRIPTION OF THE DRAWINGS

The invention will now be described with reference to the accompanying drawings in which.

DETAILED DESCRIPTION OF THE DRAWINGS

Figure 1:
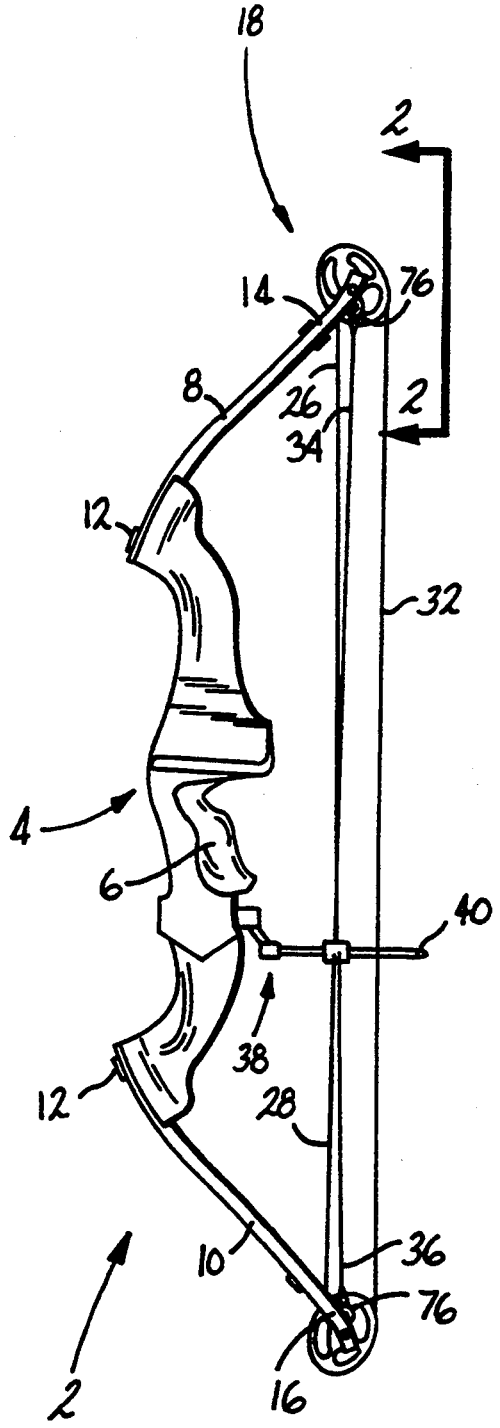
FIG. 1 illustrates a side view of a compound bow constructed in accordance with the teachings of the present invention.

As shown generally in FIG. 1, a compound bow 2 includes a center section 4 having a handle portion 6, an upper limb 8 and a lower limb 10. The limbs 8 and 10 are joined to the center section 4 by any suitable means such as screws 12. An upper end 14 of the limb 8 forms a pulley support section. Similarly a lower end 16 on the lower limb 10 forms a second pulley support section. An upper draw pulley 18 is eccentrically mounted within the upper pulley support section 14, while a lower draw pulley 22 is similarly eccentrically mounted within the lower pulley support section 16.

A first draw cable 26 passes over, and attaches to, the upper draw pulley 18 while a second draw cable 28 similarly passes over, and attaches to, the lower draw pulley 22. A bow string 32 connects to, and passes over, the draw pulleys 18 and 22. Alternatively, the draw cables 26 and 28 and bow string 34 can comprise a continuous cable reeved about the draw pulleys 18 and 22.

The inner ends of the draw cables 26 and 28 connect to the pulley support sections 14 and 16 using yokes 34 and 36, respectively. These yokes 34 and 36 will be more fully described with reference to FIGS. 2 and 3. A cable guard 38 mounts on the center section 4 and includes a rod member 40 which extends past the cables 26 and 28. Specifically, the rod portion 40 of the cable guard 38 engages the cables 26 and 28 and positions these cables to the right for a right-handed bow so as to deflect and hold the cables out of the working zone of the bow string and arrow.

Figure 2:
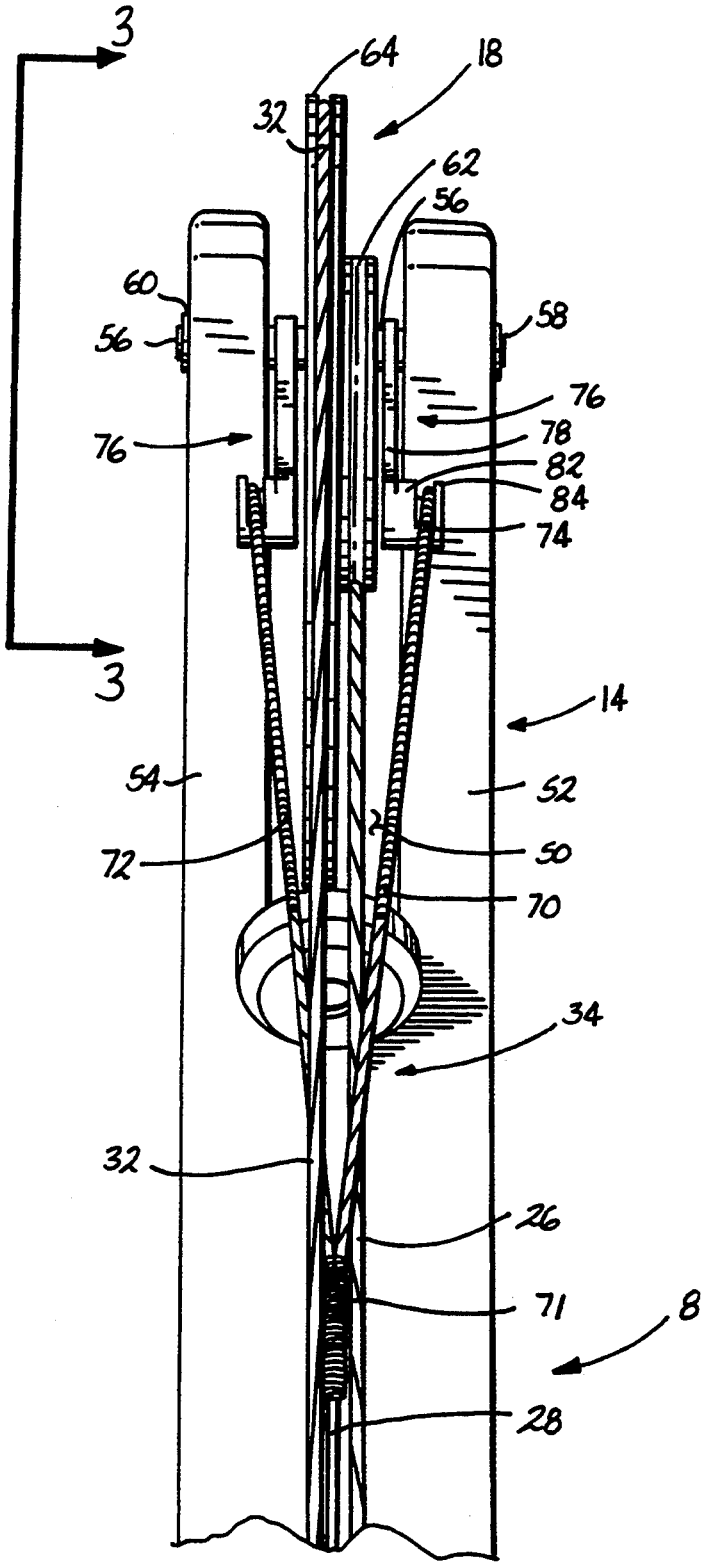
FIG. 2 is a detailed view of one limb end taken along the line 2—2 of FIG. 1.
Figure 3:
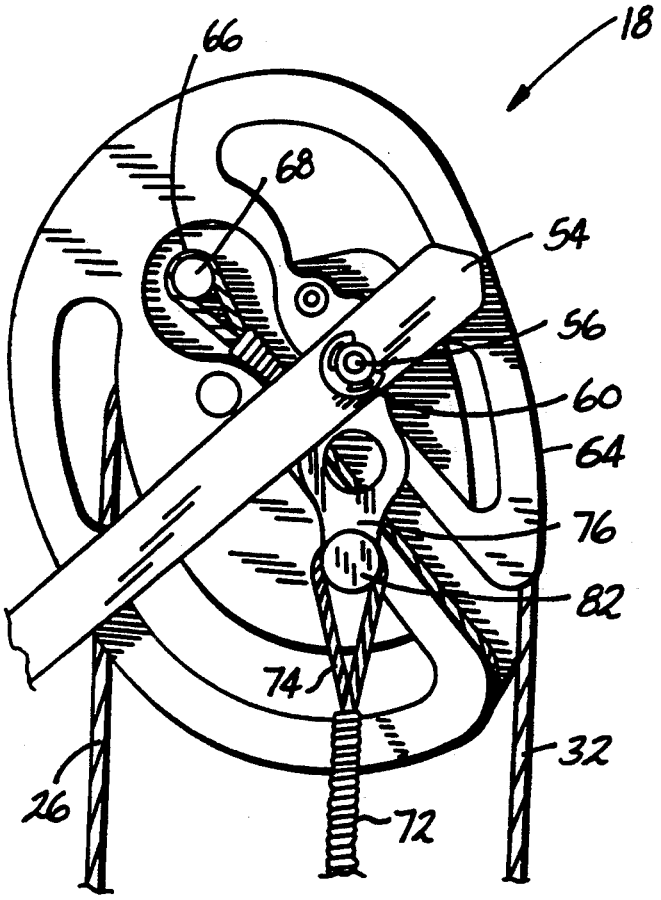
FIG. 3 is a detailed view of one limb end taken along the line 3—3 of FIG. 2.

FIGS. 2 and 3 illustrate in more detail the upper end of the limb 8 which forms the upper pulley support section 14. It is appreciated that the lower pulley support section 16 is substantially identical, and that FIGS. 2 and 3 serve as an illustration for both limbs.

In FIGS. 2 and 3, the upper end portion 14 of the limb 8 is shown to be slotted to provide an open area 50 located between two limb tip portions 52 and 54. An axle shaft 56 is supported at the end of the limb tip portions 52 and 54 and passes through and is supported in openings in the limb tip portions 52 and 54. The ends of the axle shaft 56 are held in position by retainer rings 58 and 60 which are received in grooves in the axle shaft 56. The eccentric pulley 18 is mounted for rotation on the axle shaft 56.

The first draw cable 26, as shown in FIGS. 2 and 3, passes over one grooved portion of the pulley 18, comprising a cable groove 62, and attaches at a point (not shown) internal of the pulley 18. The bow string 32 passes over another grooved portion of the pulley 18, comprising a string groove 64. A loop 66 on the end of the bow string 32 loops over, and thereby attaches, the bow string 32 to a protuberance 68 internal of the pulley 18. The second draw cable 28 is coupled to the axle shaft 56 through the use of the cable yoke 36.

As indicated above, in the prior art the end of the draw cable, such as the cable 28, couples to one side of the draw pulley 18 and attaches to the axle shaft 56 with a collet. This arrangement tends to more heavily load one side of the axle shaft, and when so loaded the limb tends to twist and the entire bow arrangement to become skewed. The present invention therefore provides for an improved compound bow wherein the limb 8 resists twisting and skewing during operation through the use of the yoke 34 to couple the end of the draw cable 28 to both sides of the eccentric wheel 18 and thereby distribute and divide the load in the fixed end of the second draw cable 28.

The end of the second draw cable 28 divides into a first end segment 70 and a second end segment 72 to form the Y-shaped upper yoke 34. An optional serving 71 may be wrapped about the draw cable 28 and the end segments 70, 72, at the point where the cable 28 divides. Each end segment 70 and 72 terminates in a closed loop 74. Each loop 74 is received upon a separate mounting bracket 76, which is in turn mounted upon the axle shaft 56.

Figure 4:
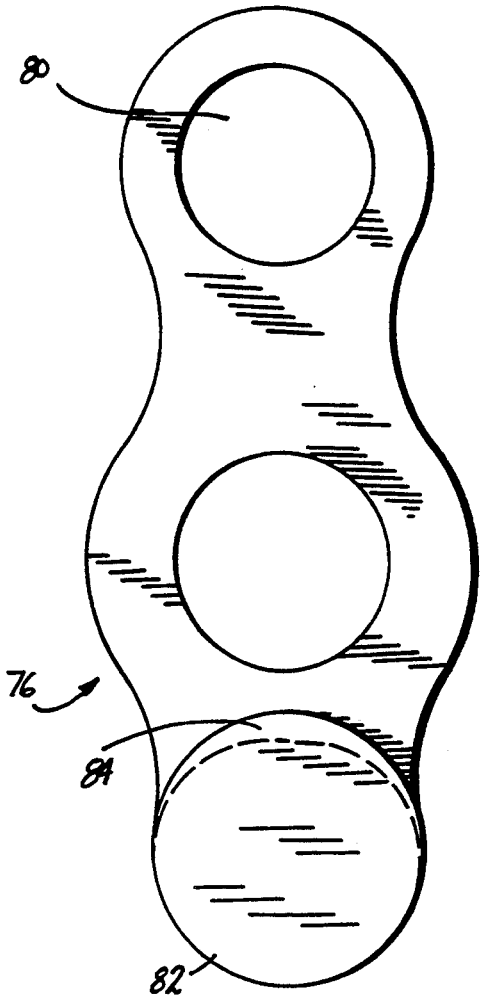
FIG. 4 is a front elevation view of the mounting bracket of FIG. 1.
Figure 5:
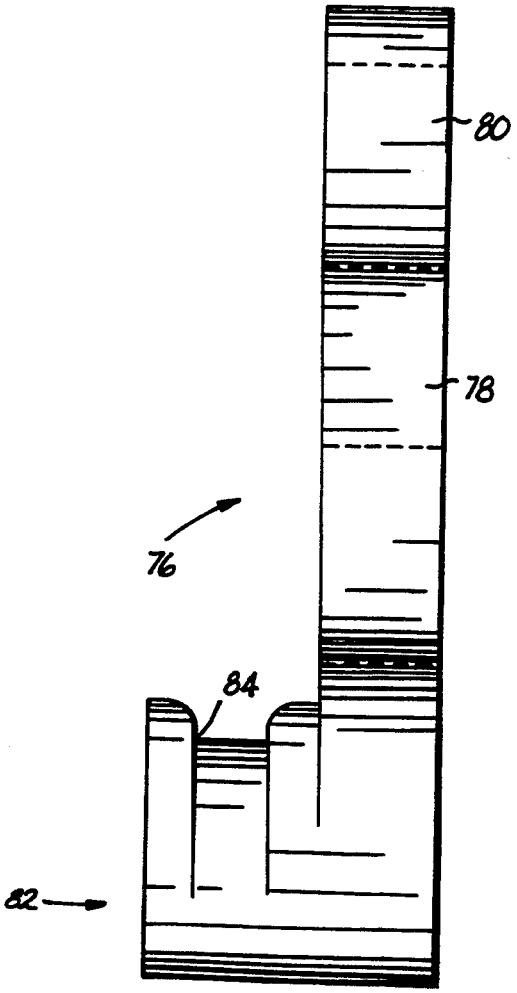
FIG. 5 is a side elevation view of the mounting bracket of FIG. 4.

Turning to FIGS. 4 and 5, each mounting bracket 76 comprises an elongated body 78 having an aperture 80 at one end and a boss 82 at its opposite end. The aperture 80 rotatably receives the axle shaft 56, allowing rotation of the mounting bracket 76 upon the axle shaft 56. The boss 82 has a generally circular cross section and extends outwardly from the mounting bracket body 78. A partial annular groove 84 may be provided in the top surface of the boss for receiving the loop 74.

Returning to FIG. 2, the mounting brackets 76 mount on the axle shaft 56, one on each side of the pulley 18, with the bosses 82 extending away from the pulley 18. Preferably the mounting brackets 76 are spaced from the limb tip portions 52 and 54 and from the pulley 18 or 22 by means of a spacer on the axle 56, or a thickened portion of the bracket 76 forming an integral spacer (not shown).

The loop 74 of the cable end segments 70 and 72 fits over the bosses 82. Thus, the fixed end of the second draw cable 28 may easily be attached to the upper end of the upper limb 14. As previously described, prior art mounting systems generally employ a collet fixedly attached to the end of the draw cable which receives the axle shaft. In such a system, removing the fixed end of the cable requires removal of the axle. The mounting brackets 76 of the present invention provide greatly increased convenience in affixing and detaching the draw cables 26, 28 to the upper end of the upper limb 14 and lower end of the lower limb 16, respectively. In each of the mounting brackets 76, the boss 82 is radially spaced from the axle 56 so that the loops 74 may be placed over the bosses 82 or removed from the bosses 82 without removing the axle 56 from its attachment between the limb tip portions 52 and 54.

Figure 6:
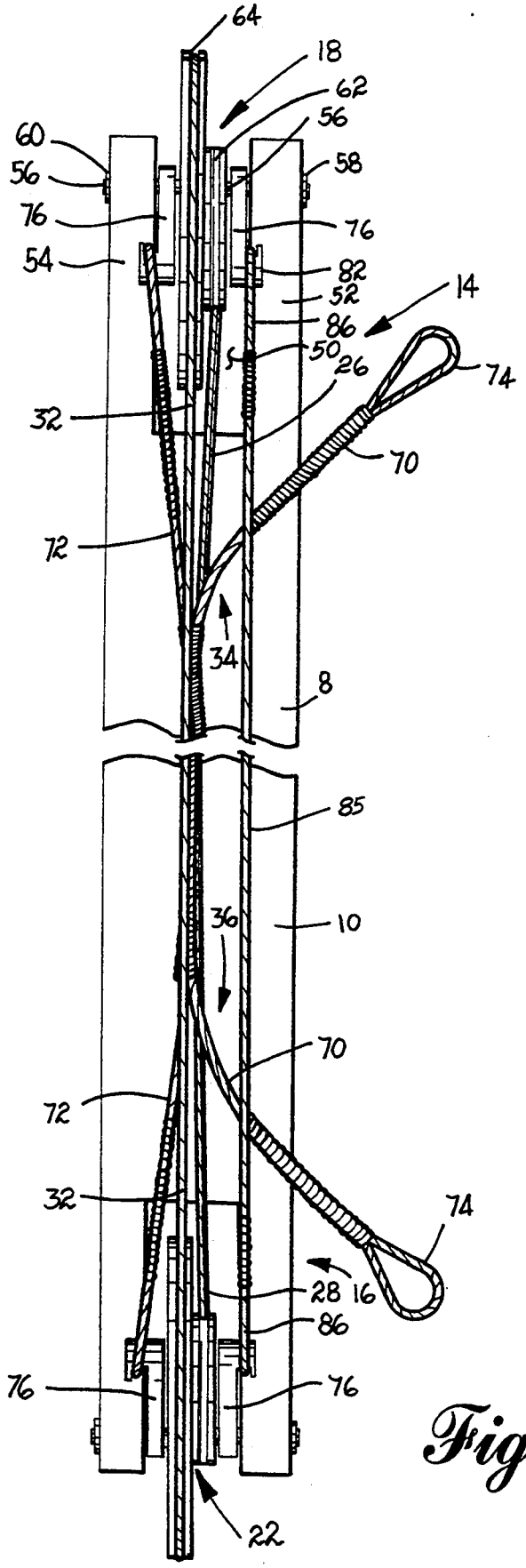
FIG. 6 is a rear elevation of the bow of FIG. 1, with an auxiliary cable affixed between the mounting brackets.

FIG. 6 illustrates an additional advantage of the yokes 34, 36 and brackets 76 of the present invention. Typically, in stringing or unstringing a bow, a bow press (not shown) is used to slightly press the upper end of the upper limb 14 towards the lower end of the lower limb 16 to relieve the tension in the draw cables 26 and 28, and bow string 32. However, the design of the present invention permits for unstringing the bow 2 without the use of a bow press. Instead, a short length of cable 85 holds the bow 2 in a compressed state, with the upper limb upper end 14 and lower limb lower end 16 drawn slightly together, thereby relieving the tension in the draw cables 26 and 28 and bow string 32.

Each of the first draw cable 26 and second draw cable 28 divides into the first end segment 70 and second end segment 72 at their fixed ends, and each end segment 70 and 72 is strong enough to carry the forces in its respective draw cable 26 and 28. Thus, the loop 74 on the first end segment 70 of each draw cable 26 and 28 may be detached from its position on the boss 82 of its corresponding mounting bracket 76, allowing the second end segment 72 to carry all of the forces in its respective draw cable 26 and 28. The auxiliary cable 85 may then be strung between the two open bosses 82 which previously held the first end segments 70.

Alternatively, the auxiliary cable 85 can be placed over the bosses 82, while the bosses 82 still contain the loops 74 of the first end segments 70. The loops 74 from the second end segment 72 are then removed from their bosses 82, the bow 2 is restrung with a new cable arrangement, and the loops 74 of the second end segment 72 of the new cable arrangement are looped over their respective bosses 82. The auxiliary cable 85 is then removed, placing the load of the bow 2 onto the new cable arrangement, the load being carried by the second end segments 72. The first end segments 70 of the old cable arrangement are removed from their bosses 82, and the new cable arrangement first end segments 70 are placed onto the bosses 82, completing the job of restringing the bow 2.

The auxiliary cable 85 has loops 86 at each end which can be placed over the bosses 82. It can also comprise a single large loop of cable, or be provided with hooks or other appropriate means for engaging the open bosses 82. The auxiliary cable 85 is of a length such that when it is positioned upon the bosses 82, it holds the bow 2 in a compressed state sufficient for unstringing the draw cables 26 and 28, and bow string 34. Typically, a user must apply a compressive force between the upper limb upper end 14 and lower limb lower end 16 to compress the bow 2 so that the auxiliary cable 85 may be looped about the bosses 82. This force can be applied by placing the lower limb 10 on the ground and leaning against the upper limb 8, or by placing the handle portion 6 against a bracing surface and partially drawing the bow string 32, thereby drawing the limbs 8 and 10 together. Alternatively, the tension on the first end segment 70 can be released by pulling the second end segment 72 toward the bow limb 8 or 10, as by squeezing the second end segment 72 and bow limb 8 or 10 in one's hand. A bow press is not required. Thus, a user not having access to a bow press can unstring or restring his bow.

Such restringing can occur in the field where it is inconvenient to carry a bow press.

Returning to FIG. 2, the Y-shaped yoke 34 also enables a user to fine tune the forces applied by the second draw cable 28 to the axle shaft 56. In general, the forces in the first and second end segments 70, 72 are equal and balanced on either end of the axle shaft 56. However, the forces applied by the first draw cable 26 acting in the cable groove 62 are not balanced by the lesser force of the bow string 32 acting in the string groove 64. For instance, at the full draw condition of the bow 2, the eccentrically mounted pulley 18 causes the force in the bow string 32 to be approximately half of the force in the first draw cable 26.

To compensate for the unequal application of forces in the bow string 32 and first draw cable 26, the forces applied by the first end segment 70 and second end segment 72 may be adjusted. For instance, if the second end segment 72 is twisted several turns before being placed upon the boss 82, it will have a shorter length than the first end segment 70, thereby carrying a greater percentage of the force in the second draw cable 28. Thus, a user may selectively balance the forces applied along the axle shaft 56 to suit his or her preferences.

Figure 7:
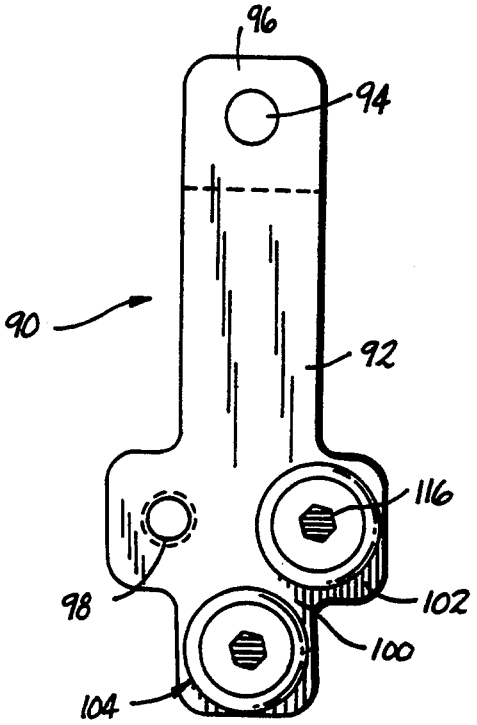
FIG. 7 is a front elevational view of a second embodiment of a mounting bracket according to the invention.
Figure 8:
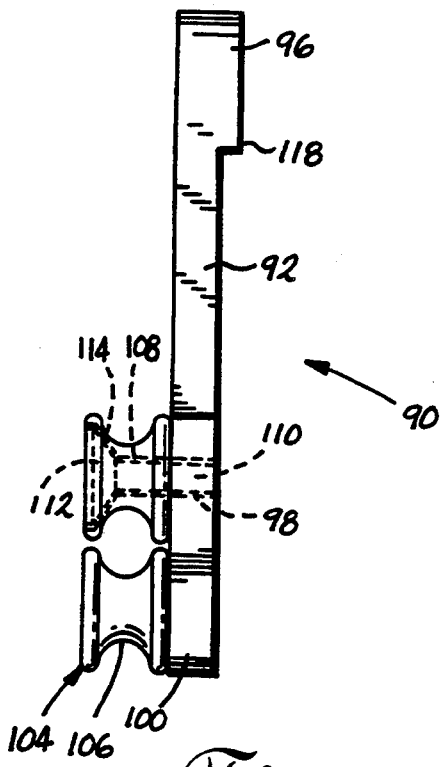
FIG. 8 is a side elevational view of the mounting bracket of FIG. 7.

FIGS. 7 and 8 illustrate a second embodiment of a mounting bracket 90 according to the invention. The mounting bracket 90 comprises an elongated body 92 having an axle aperture 94 at a first end 96, and three threaded apertures 98 at a second end 100. Preferably, the body 92 is formed into a cross shape with outwardly extending arms 102 upon which two of the threaded apertures 98 can be located, leaving the third threaded aperture 98 at the body second end 100, distal of the arms 102. Each threaded aperture 98 is adapted to mount a pulley shaped boss 104. Each boss 104 comprises an annular receiving groove 106 about its circumference, and a central mounting aperture 108. A screw 110 having a head 112 passes through the mounting aperture 108 and threads into one of the threaded apertures 98 to mount the boss 104 to the body 92. The mounting aperture 108 can have a conical section 114 at one end, for counter-sinking the screw head 112 into the boss 104, so that the screw head 112 will be flush with the surface of the boss 104.

Preferably the screw heads 112 are provided with an hexagonal shaped well 116, adapted to receive hexagonal shaped driver (not shown), commonly known as an Allen wrench. However, other driver arrangements are acceptable, such as Phillips or slotted heads. Preferably, one boss 104 is mounted in the lowermost threaded aperture 98, with the second boss 104 mounted in the threaded aperture 98 in one of the arms 102. When the mounting bracket 90 is mounted onto the bow 2 (not shown in FIGS. 7 and 8), the unused threaded aperture 98 on the remaining arm 102 preferably faces towards the bow limb 8 or 10 (also not shown in FIGS. 7 or 8). An integral spacer 118 may be formed onto the body 92 at the axle mounting aperture 94. The spacer 118 comprises a thickening of the body 92 in the direction away from the face upon which the bosses 104 are mounted.

The mounting bracket 90 having two bosses 104 allows tension to be adjusted by mounting the end loop 74 (not shown in FIGS. 7 and 8) selectively on either boss 104. Also, one boss 104 may be employed for mounting an end loop 74, while the remaining boss 104 may be employed for mounting the auxiliary cable loops 86 (also not shown in FIGS. 7 and 8) in the previously described restringing procedure.

Figure 9:
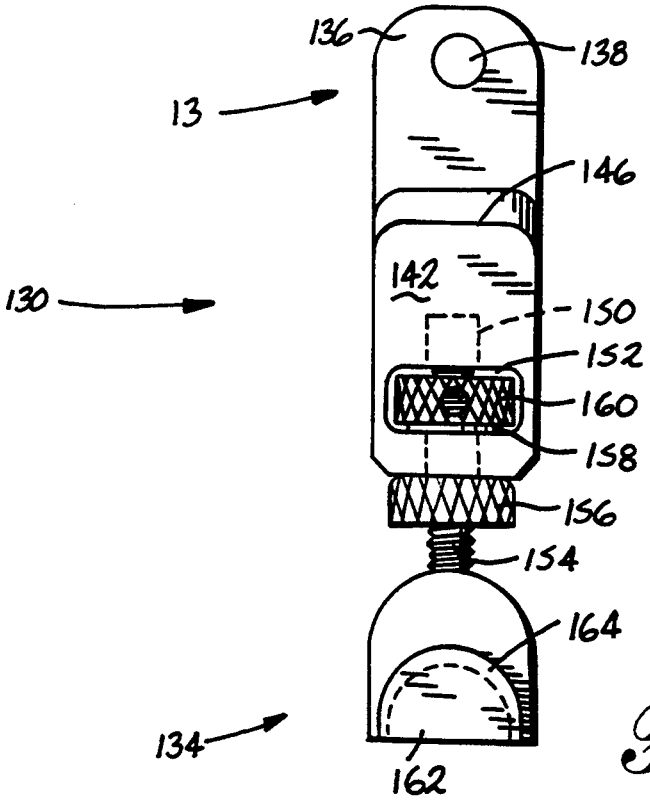
FIG. 9 is a front elevational view of a third embodiment of a mounting bracket according to the invention.
Figure 10:
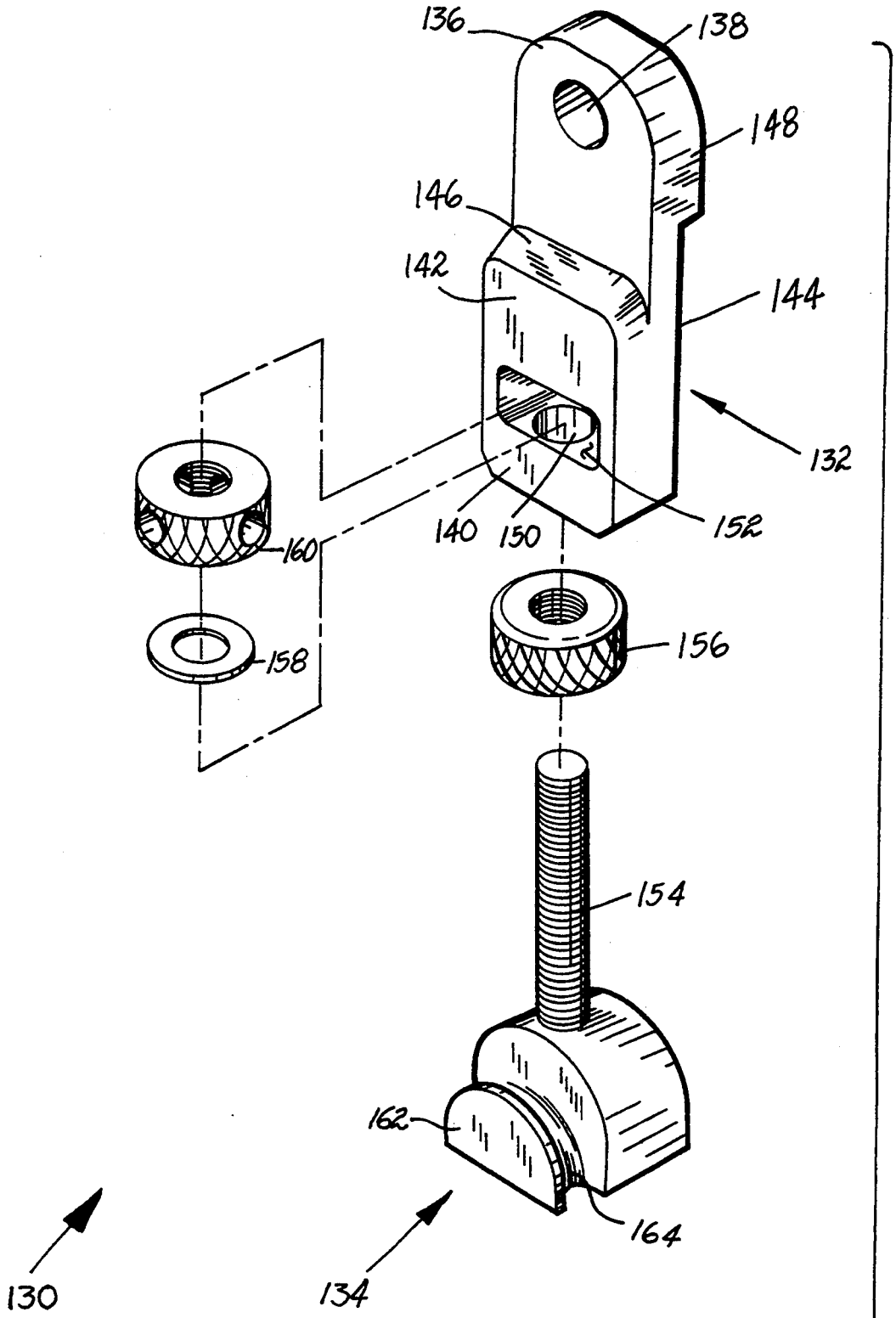
FIG. 10 is an exploded isometric view of the mounting bracket of FIG. 9.

FIGS. 9 and 10 illustrate a third embodiment of a mounting bracket 130 according to the invention, which allows easy adjustment of the tension in each individual cable end 72 (not shown in FIGS. 9 and 10). The mounting bracket 130 comprises an upper elongated body 132 and a lower body 134 connected by a threaded rod 154. The upper body 132 comprises a first end 136, having a mounting aperture 138 therethrough, a second end 140, a front face 142, and a rear face 144. The front face 142 slopes inwardly at a transition section 146, thereby reducing the depth of the upper body 132 at its first end 136. However, a spacer 148, integrally formed with the upper body 132, extends rearwardly from the rear face 144 at the mounting aperture 138.

A rectangular aperture 152 penetrates the upper body 132 through its front face 142 and rear face 144, near its second end 140. A bore 150 extends longitudinally into the upper body 132, from its second end 140, past the rectangular aperture 152. The threaded rod 154 extends longitudinally from the lower body 134 into the bore 150, passing through a lock nut 156 (external of the upper body 132), into the bore 150, and then through an elastomeric washer 158 and a positioning nut 160 positioned within the upper body rectangular aperture 152. The relative axial position of the lower body 134 with respect to the upper body 132 can thus be adjusted and fixed by means of the threaded rod 154 and the nuts 156 and 160.

A boss 162 having an annular receiving groove 164 extends outwardly from the lower body 134 for receiving the end loop 74 (not shown in FIGS. 9 and 10). Referring also to FIG. 6, the mounting brackets 130 replace the mounting brackets 76. The mounting brackets 130 are mounted on the axle 56 with their spacers 148 facing towards the draw pulley 18. Thus, the tension in each individual end segment 72 may be adjusted to adjust the torque applied to the limb tip 14. Also, the adjustability of the mounting brackets 130 allows the overall tension in the cable 28 to be adjusted.

Figure 11:
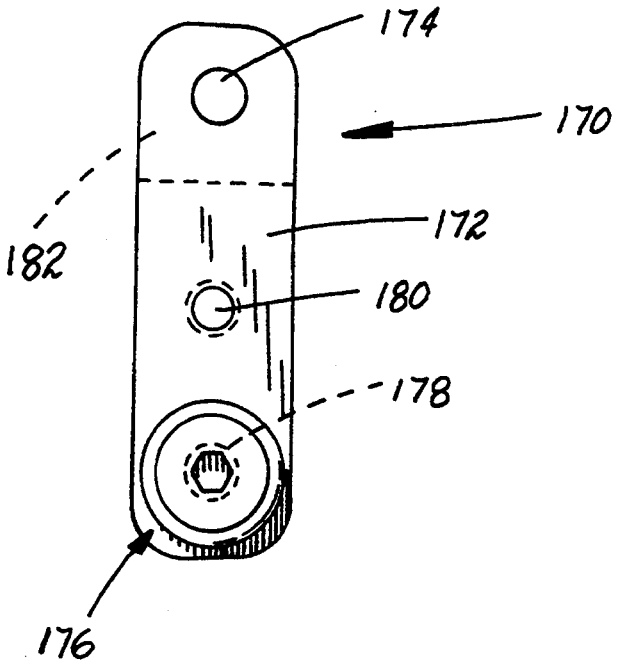
FIG. 11 is a front elevational view of a fourth embodiment of a mounting bracket according to the invention.

Referring to FIG. 11, a fourth embodiment of a mounting bracket 170 is disclosed having an elongated body 172, a mounting aperture 174 at one end of the body 172, and a removable boss 176 mounted at an opposite end of the body 172. The boss 176 is identical to the previously described boss 104, and threadably mounts in either a threaded lower aperture 178, or a threaded intermediate aperture 180 located between the lower aperture 178 and the mounting aperture 174. As in the previous two embodiments, an integrally formed spacer 182 extends outwardly from the body 172 at the mounting aperture 174 in the opposite direction from which the boss 176 extends from the body 172. By selectively mounting the boss 176 in the intermediate aperture 180, the tension in the cables (not shown in FIG. 11) can be increased, or longer cables may be employed while maintaining the design tension in the cables.

Figure 12:
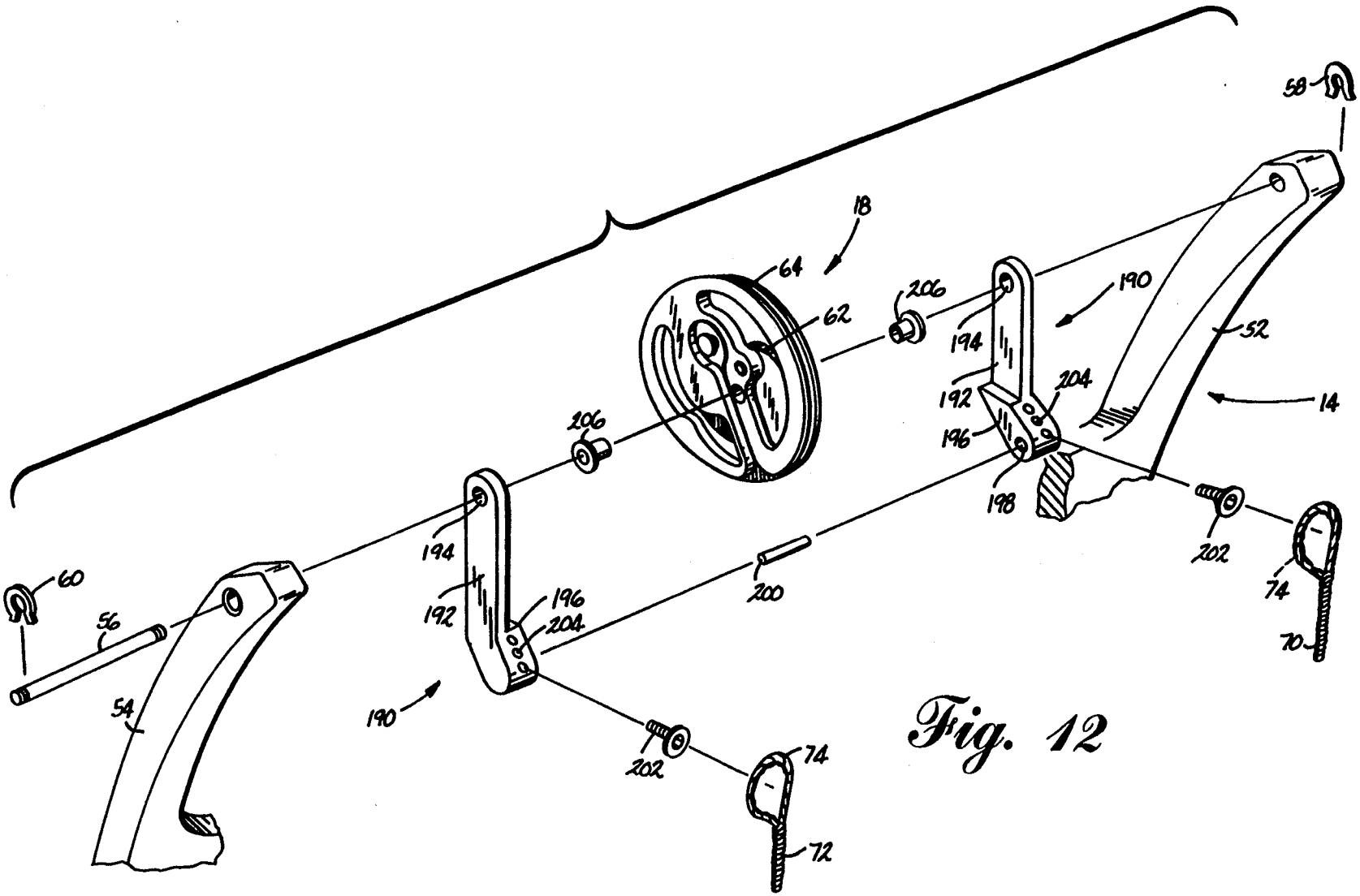
FIG. 12 is an exploded perspective view of a bow limb end and a fifth embodiment of a mounting bracket according to the invention.

FIG. 12 illustrates a fifth embodiment of a mounting bracket 190 which comprises an elongated body 192. A mounting aperture 194 at one end of the body 192 receives the pulley axle 56. As in the previous embodiments, one mounting bracket 190 mounts upon the axle 56 on each side of the pulley 18. At the opposite end of the body 192 from the mounting aperture 194, a thickened portion of the body 192 forms an integral spacer 196. With the mounting brackets 190 mounted upon the axle 56, the spacers 196 face and abut each other to maintain the spacing between the mounting brackets 190 against the tension in the cable ends 70, 72. Otherwise, one or both of the brackets 190 might possibly bind against the pulley 18. Aligned blind openings 198 in the spacers 196 receive a pin 200 so that the mounting brackets 190 rotate in unison on the axle 56. Preferably, one of the openings 198 receives the pin 200 with a friction fit, and the other of the openings 198 loosely receives the pin 200 within.

A boss 202 selectively threads into one of several threaded openings 204 in each of the integral spacers 196. It will be apparent that the body 192 of the present embodiment is sufficiently long so that the boss 202 is disposed radially away from the periphery of pulley 18. Wherein the bosses 82, 104, 162, 176 of the previous embodiments extend normally from the plane of the pulley, the bosses 202 extend parallel, placing them closer to the plane of the pulley. A plurality of threaded openings 204 on each mounting bracket 190 allows separate adjustment of tension in each of the cable ends 70, 72, and also permits overall adjustment of tension in the cable 28.

An integral spacer can be formed in the body 192 at the mounting aperture 194 as in the previous embodiment, or a separate spacer 206, as illustrated in FIG. 12 can be provided for spacing the mounting bracket 190 from the pulley 18. The separate spacers 206 mount on the axle 56 between the pulley 18 and the mounting brackets 190.

Figure 13:
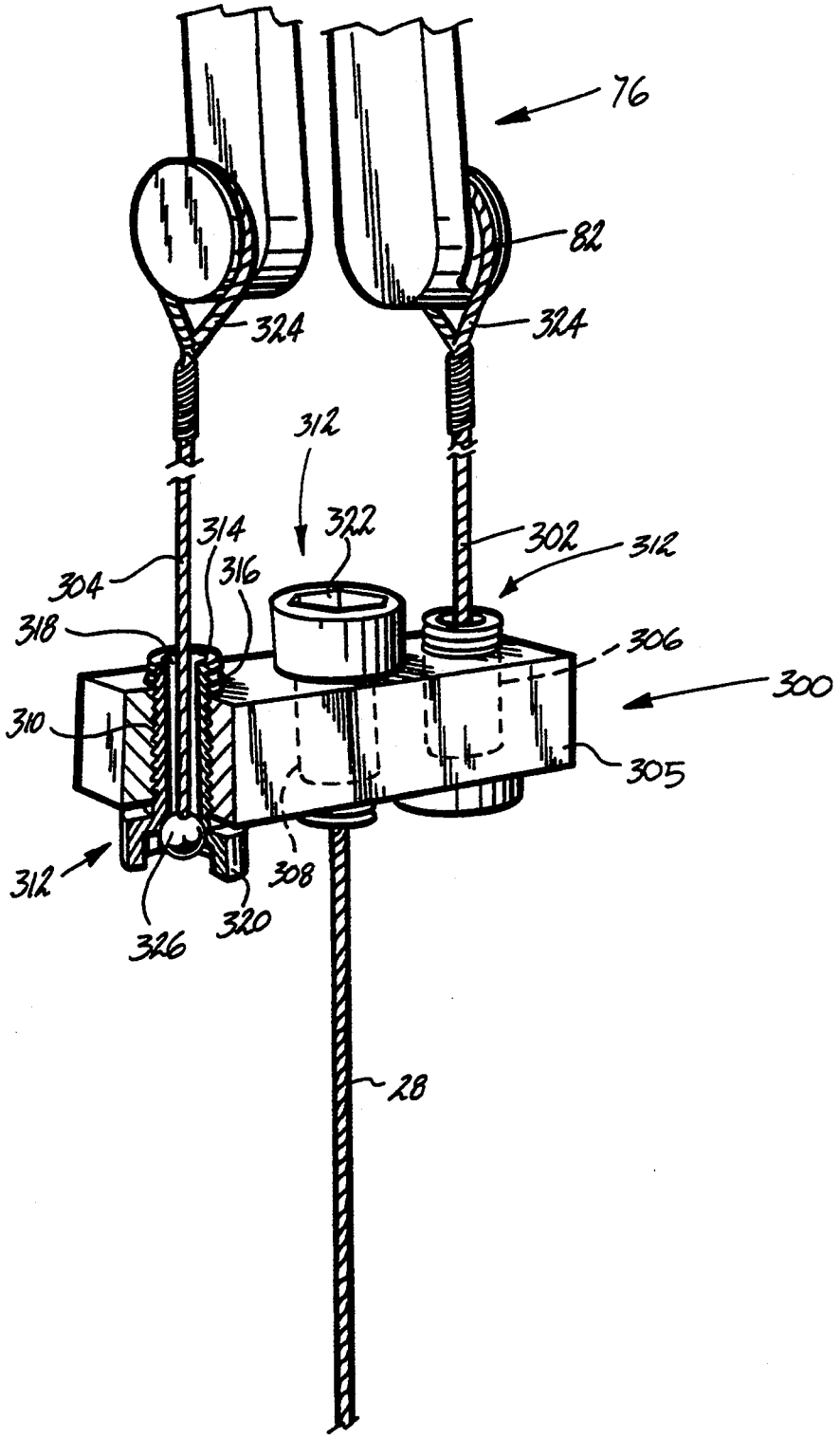
FIG. 13 is a detailed isometric view in partial section of a yoke adjuster according to the invention.

FIG. 13 illustrates a yoke adjuster 300 interposed between one of the draw cables, for instance the second draw cable 28, and two separate draw cable end segments 302, 304, which correspond to the end segment 70 and 72 of the previous embodiments. The yoke adjuster 300 comprises a rectangular prismatic body 305 having three parallel adjacent threaded apertures therethrough, i.e., outer apertures 306 and 310, and a central aperture 308 between the outer apertures 306 and 310. Each aperture 306, 308, 310 receives a threaded fitting 312 which comprises a tubular body 314 having external threads 316 and a central coaxial bore 318 therethrough. One end of the fitting body 314 expands radially outwardly to form a head 320. The head 320 is provided with an opening for a driver, such as a hexagonal opening 322 for a hex driver (not shown).

Each of the end segments 302 and 304 terminates in end loops 324 at one end and an enlarged sphere 326 at an opposite end. The sphere 326 is received within the driver opening 322, and the cable end segment 304 passes through the central coaxial bore 318. The loop 324 on the end segment 304 fits over the boss 82 on the mounting bracket 76, as in the previous embodiments. The diameter of the sphere 326 exceeds the diameter of the bore 318, preventing the sphere 326 from passing through the bore 318. The end segment 302 is similarly constructed and retained within the corresponding threaded fitting 312. The second draw cable 28 also terminates in a similar sphere 326 (not shown). However, the threaded fitting 312 passes through the central aperture 308 in the opposite direction from which the fittings 312 pass through the outer apertures 306 and 310. Thus, the tension in the second draw cable 28 pulls the draw cable sphere 326 against the fitting 312 in the central aperture 308, urging the yoke adjuster body 305 away from the mounting brackets 76. However, the end segments 302 and 304, acting through the fittings 312 in the outer apertures 306 and 310, resist the pull of the draw cable 28.

The threaded fittings 312 enable adjustment of the tension in the second draw cable 28 and in the end segments 302 and 304. For instance, rotating the threaded fitting 312 in the central aperture 308 counterclockwise increases the tension in the second draw cable 28 and also equally increases the tension in the end segments 302 and 304. However, the threaded fittings 312 in the outer apertures 306 and 310 can be independently used to adjust the tension in the individual end segments 302 and 304, respectively. For instance, a shooter may desire to fine tune the shooting characteristics of the bow by applying more or less tension to an individual one of the end segments 302 or 304.

Preferably, the yoke adjuster body 305 and threaded fittings 312 are formed of a strong yet light weight material, such as aluminum. However, any number of materials, such as nylon or other plastics, and steel or other metals would be suitable for either the yoke adjuster body 305 or threaded fittings 312. The yoke adjuster 300 is particularly well suited for use with bows having high tension aircraft cable as the material for the draw cable 28 and end segments 302 and 304.

Reasonable variation and modification are possible within the scope of the foregoing disclosure and drawings without departing from the spirit of the invention, as defined in the accompanying claims. For instance, although the mounting brackets 76 are preferably mounted to the axle shaft 56, separate bosses 82 may be provided anywhere on the upper end of the upper limb 14 for mounting the first and second end segment 70, 72. Bearings or bushings may be provided within the apertures 80 of the mounting bracket 76 to enhance its rotational capability on the axle shaft 56. The bosses 82 may either be integrally formed with the body 78 of the mounting bracket 76 or separately attached. In which case, the bosses 82 may also be provided with bearings. Other means may be provided for releasably attaching the ends of the cables to the mounting brackets 76. For instance, clips or other attachment means may replace the loops 74, or supplement the loops 74, on the cable free ends. The mounting brackets 76 are not limited to cables having separate end segments 70, 72. They are suitable for use with a regular draw cable, which does not have a Y-shaped end, but has a single loop at its end. Also, the yoke adjuster 300 can obviously be employed with the end segments 302 and 304 mounted with a standard axle sheaves (not shown) to the axle shaft 56 in the convention fashion.

The embodiments of the invention in which an exclusive property or privilege is claimed are as follows:

1. In a compound bow having a center handle portion; first and second limbs having inner ends connected to the center handle portion and free outer ends, each of the first and second limbs having an axle mounted on its respective free outer end, the axle passing laterally through a pulley to rotatively mount the pulley; a cable, under tension, extending between the pulley on one free outer end and the other free outer end; and a yoke assembly, the cable having at least one end mounted to a free outer end by the yoke assembly, an improvement wherein the yoke assembly comprises:

a body having two outer mounting fixtures, the at least one cable end being mounted to the body;

two discrete cable segments, each cable segment having a first end and a second end, the first ends being mounted to the free outer ends on opposite lateral sides of the pulley, each second end being mounted to and retained by a corresponding outer mounting fixture on the body to define a predetermined length of each cable segment; and each outer mounting fixture being adjustable whereby to enable independent adjustment of the predetermined length in each cable segment.

2. A compound bow according to claim 1 wherein the body further comprises a central mounting fixture disposed between the outer mounting fixtures, the central mounting fixture mounting the at least one cable end to the body.

3. A compound bow according to claim 2 wherein the outer mounting fixtures and the central mounting fixture are in rank.

4. A compound bow according to claim 1 wherein each of the adjusting mechanisms comprises a threaded opening in the body and a threaded fitting within the opening, the cable segment second end mounted to the fitting, whereby adjustment of the threaded fitting within the threaded opening adjusts the tension in the cable segment.

5. A compound bow according to claim 4 wherein the cable segment aligns axially with the fitting.

6. A compound bow according to claim 4 wherein the threaded fitting further comprises a coaxial bore therethrough, the cable segment passes coaxially through the bore and the cable segment second end further comprises a stop having a dimension larger than the bore wherein the stop abuts the fitting and will not pass through the bore.

7. A compound bow according to claim 1 further comprising each of the cable segment first ends having a loop, one of the loops receiving a boss located on one side of the respective pulley, and the other of the loops receiving a boss on the opposite side of the pulley.

8. A compound bow according to claim 7 further comprising an axle mounting one of the pulleys to the respective limb free outer end and a pair of mounting brackets, each mounting bracket having an elongated body, the body having an aperture receiving the axle, one of the mounting brackets being received on the axle on one side of the pulley and the other of the mounting brackets being received on the axle on the opposite side of the pulley, and each of the mounting brackets having one of the bosses mounted thereto.

9. In a compound bow having a center handle portion; first and second limbs having inner ends connected to the center handle portion and free outer ends, each of the first and second limbs having a pulley mounted on its respective outer free end; a cable, under tension, extending between the pulley on one free outer end and the other free outer end; and a yoke assembly, the cable having at least one end mounted to a free outer end by the yoke assembly, an improvement in the yoke assembly comprising:

a body having two threaded outer apertures therethrough and a threaded fitting within each of the outer apertures;

two cable segments, each cable segment having a first end and a second end, the first ends being mounted to the limb outer free end on opposite sides of the pulley;

each of the cable segment second ends mounting to one of the fittings, whereby adjustment of the threaded fittings within the threaded openings adjusts the tension in the cable segments.

10. A compound bow according to claim 9 wherein each of the threaded fittings further comprises a coaxial bore therethrough, the respective cable segment passes coaxially through the bore and each of the cable segment second ends further comprises a stop having a dimension larger than the respective bore wherein the stop abuts the fitting and will not pass through the bore.

11. A compound bow according to claim 10 further comprising a threaded central aperture therethrough between the outer apertures, the outer apertures and the central apertures being in rank, and a threaded fitting within the central aperture, the threaded fitting in the central aperture having a bore therethrough and the at least one cable end passes through the central aperture fitting bore and further comprises a stop having a dimension larger than the central aperture fitting bore wherein the stop abuts the fitting and will not pass through the central aperture fitting bore.

12. In a compound bow having a center handle portion; first and second limbs having inner ends connected to the center handle portion and free outer ends, each of the first and second limbs having an axle mounted on its respective free outer end, the axle passing laterally through a pulley to rotatively mount the pulley; a cable, under tension, extending between the pulley on one free outer end and the other free outer end; and a yoke assembly, the cable having at least one end mounted to a free outer end by the yoke assembly, an improvement wherein the yoke assembly comprises:

a body;

two cable segments, each cable segment having a first end and a second end, the first ends being mounted to the outer free end on opposite lateral sides of the pulley; and a tension distribution means for adjusting the load carried by each cable segment.

13. A compound bow according to claim 12 further comprising a central mounting means on the body for adjustably mounting the at least one cable end to the body and adjusting the tension in the cable.

14. A compound bow according to claim 13 wherein each of the adjustable mounting means comprises a threaded opening in the body and a threaded fitting within the opening, the cable segment second end mounted to the fittings in the outer mounting means and the at least one cable end mounting to the fitting in the central mounting means.

15. A compound bow according to claim 12 wherein the tension distribution means comprises two separate outer adjustable mounting means on the body for adjustably mounting the cable second ends to the body wherein each cable segment will be under tension and the adjusting mechanisms enable independent adjustment of the tension in each cable segment.

* * * * *